US006895665B2

(12) United States Patent
Sakai

(10) Patent No.: US 6,895,665 B2
(45) Date of Patent: May 24, 2005

(54) METHOD OF MANUFACTURING A HOUSING FOR ELECTRONIC PARTS

(75) Inventor: Akira Sakai, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/454,175

(22) Filed: Jun. 4, 2003

(65) Prior Publication Data

US 2003/0226255 A1 Dec. 11, 2003

(30) Foreign Application Priority Data

Jun. 6, 2002 (JP) ..... 2002-165435

(51) Int. Cl.[7] ..... H01R 43/00

(52) U.S. Cl. ..... 29/827; 29/832; 29/825; 29/858; 333/1.1

(58) Field of Search ..... 439/66, 70; 29/827, 29/832, 884, 602.1, 592.1, 846; 333/1.1, 24.2; 174/52.1; 361/303, 301.1

(56) References Cited

U.S. PATENT DOCUMENTS 5,159,294 A * 10/1992 Ishikawa et al. ..... 333/1.1
6,037,844 A * 3/2000 Makino et al. ..... 333/1.1
6,215,371 B1 * 4/2001 Kurahashi et al. ..... 333/1.1
6,469,588 B1 * 10/2002 Makino et al. ..... 333/1.1
6,625,869 B2 * 9/2003 Jodo ..... 29/602.1
2003/0226255 A1 * 12/2003 Sakai ..... 29/846

FOREIGN PATENT DOCUMENTS

JP 7-273506 * 10/1995
JP 2002-076713 3/2002

* cited by examiner

*Primary Examiner*—Minh Trinh
(74) *Attorney, Agent, or Firm*—Brinks Hofer Gilson & Lione

(57) ABSTRACT

A method of manufacturing a housing for electronic parts, such as isolators, or the like, with as small non-plated portions as possible, which housing is obtained by separating a housing part from a metallic housing part support with the housing part connected to a frame through connections, the method comprising the steps of cutting off and removing the connections after provisional connections of a resin are formed on the housing part support to connect the frame to the housing part, and obtaining the housing for electronic parts by removing the provisional connections after plating is applied to surfaces of the housing part including cut portions of the connections.

4 Claims, 6 Drawing Sheets

METHOD OF MANUFACTURING A HOUSING FOR ELECTRONIC PARTS

This application claims the benefit of priority to Japanese Patent Application 2002-165435 filed on Jun. 6, 2002.

BACKGROUND OF THE INVENTION

1. Field of the Invention

The present invention relates to a method of manufacturing a housing for electronic parts, and more particular, to a method of manufacturing a housing for high-frequency electronic parts of a non-reciprocal circuit element such as isolators, or the like.

2. Background Art

Generally, a concentrated constant type isolator or circulator used in a relatively high frequency band, such as UHF, VHF, SHF, or the like, functions to pass a signal only in a direction of transmission and prevent transmission in an opposite direction, and is widely adopted in transmitting circuits of mobile communication equipments such as portable telephones or the like.

The isolator is mainly composed of, for example, a magnetic assembly made of ferrite and a central conductor, and a permanent magnet, these elements being received in a housing. Ordinarily, silver plating with low electrical resistivity is applied to surfaces of the housing so as to convert noise into eddy current to discharge the same.

Such housing for isolators is manufactured by preparing, for example, a metallic housing part support, in which a plurality of housing parts are successively connected to a frame through connections, and separating the respective housing parts after silver plating is applied to the housing part support. Since the plurality of housing parts are collectively subjected to plating processing in a state of being connected to the frame, it is possible to plate the plurality of housing parts at a time, and workability at the time of plating processing is prevented from being lowered particularly in the case where the housing is small in size.

Since housing parts are subjected to plating and then cut off from a frame in a conventional method of manufacturing a housing for isolators, however, cut surfaces are not plated and left as they are. When plating remains incomplete, there is a fear that it becomes difficult to eliminate influences of high-frequency noise. Also, in the case where cut surfaces being not plated make terminals of an isolator, there is a fear that when the isolator is soldered to a circuit board, soldering becomes worse to cause contact failure.

SUMMARY OF THE INVENTION

The invention has been thought of in view of the situation, and has its object to provide a method of manufacturing a housing for electronic instrument parts such as isolators, or the like, the housing including as small non-plated portions as possible.

In order to attain the object, the invention adopts the following configuration.

The invention provides a method of manufacturing a housing for electronic parts, which is obtained by separating a housing part from a metallic housing part support with the housing part connected to a frame through connections, the method comprising the steps of cutting off and removing the connections after provisional connections of a resin are formed on the housing part support to connect the frame to the housing part, and obtaining the housing for electronic parts by removing the provisional connections after plating is applied to surfaces of the housing part including cut portions of the connections.

Since the method of manufacturing a housing for electronic parts, according to the invention, comprises after formation of the provisional connections, cutting off and removing the connections, and applying plating to surfaces of the housing part including cut portions of the connections, a greater part of the housing part can be subjected to plating, and those portions, on which plating is not applied, are decreased as compared with the prior art to improve the high frequency property and enhance soldering in strength, which makes it possible to decrease contact failure.

Also, the method of manufacturing a housing for electronic parts, according to the invention, has a feature in further comprising the steps of forming side wall portions of the housing part integrally with the provisional connections, and cutting off the provisional connections from the side wall portions when the provisional connections are to be removed.

According to the method of manufacturing a housing for electronic parts, the side wall portions can be left on the housing part by forming side wall portions of the housing part integrally with the provisional connections, and cutting off the provisional connections from the side wall portions when the provisional connections are to be removed.

Also, the method of manufacturing a housing for electronic parts, according to the invention, has a feature in further comprising the steps of providing supports, which project toward the housing part from the frame, and providing independent terminals on tip ends of the supports, and joining the independent terminals to the side wall portions at the time of formation of the provisional connections and the side wall portions, and then cutting off and removing the supports together with the connections.

According to the method of manufacturing a housing for electronic parts, the supports together with the connections are cut off and removed in a state, in which the independent terminals are joined to the side wall portions, so that the independent terminals can be joined to the housing part in an insulated condition and used as input/output terminals of an electronic part.

Also, with the method of manufacturing a housing for electronic parts, according to the invention, it is preferable that cut portions of the connections on a side of the housing part make separate terminals.

DESCRIPTION OF THE PREFERRED EMBODIMENTS

Embodiments of the invention will be described below with reference to the drawings.

First, an explanation will be given to a non-reciprocal circuit element, which makes an example of electronic parts according to the invention.

Figure 1:
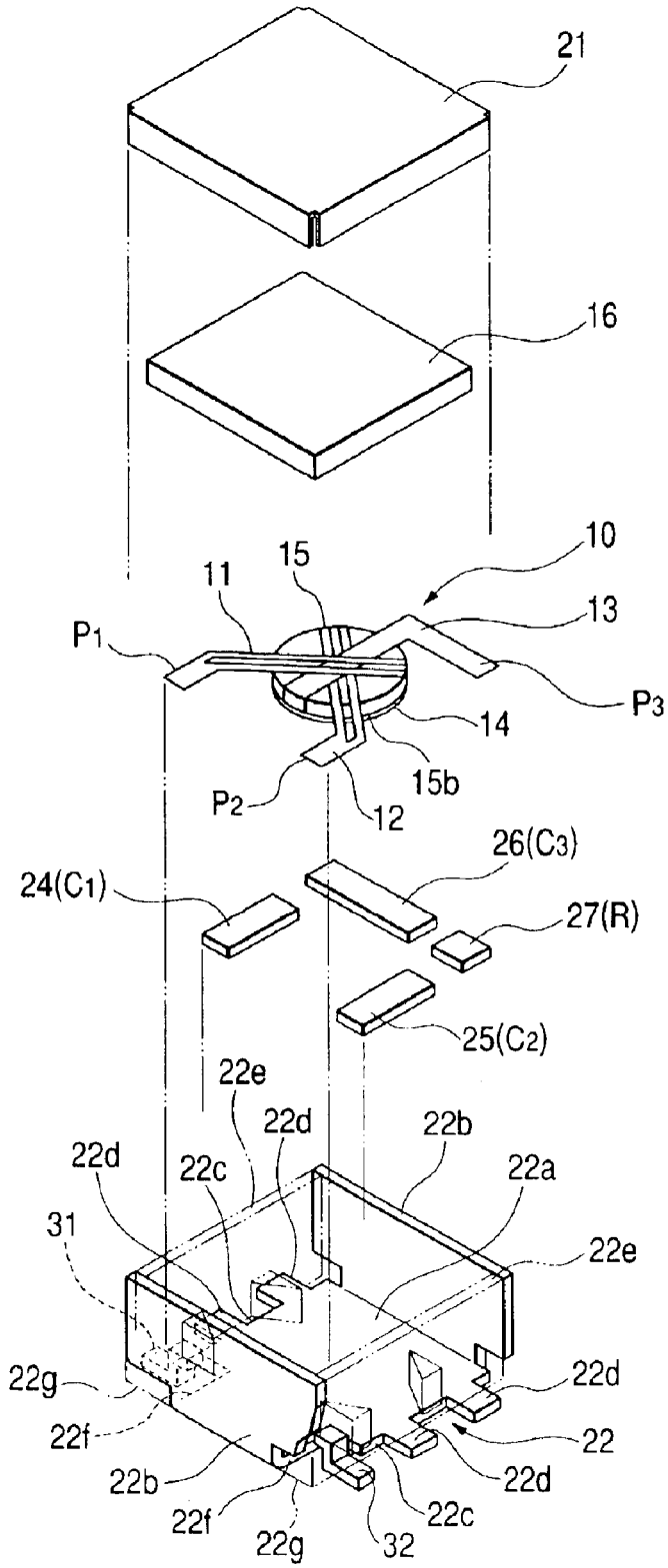
FIG. 1 is an exploded, perspective view showing an isolator according to an embodiment of the invention.

FIG. 1 is an exploded, perspective view showing an essential part of a non-reciprocal circuit element according to an embodiment of the invention.

The non-reciprocal circuit element 1 shown in FIG. 1 is mainly composed of a magnetic assembly 10 and a permanent magnet 16. The magnetic assembly 10 and the permanent magnet 16 are received, as shown in FIG. 1, in a closed magnetic circuit (magnetic yoke), which is composed of an upper yoke 21 and a lower yoke (housing for electronic parts) 22, in other words, between the upper yoke 21 and the lower yoke 22.

Further, received in the upper yoke 21 and the lower yoke 22 are capacitor plates 24, 25, 26 and a terminating resistance plate 27 (R).

In addition, a capacitor C1 is built in the capacitor plate 24, a capacitor C2 is built in the capacitor plate 25, a capacitor C3 is built in the capacitor plate 26, and a terminating resistance R is built in the terminating resistance 27.

The magnetic assembly 10 comprises a plate-shaped magnet 15 made of a flat disk ferrite, a common electrode 14 provided on a lower surface 15*b* of the plate-shaped magnet and made of a metallic disk having substantially the same shape as that of the plate-shaped magnet 15, and first, second and third central conductors 11, 12, 13 formed to extend from the common electrode 14 in three radial directions and trained on an upper surface 15*a* of the plate-shaped magnet 15.

All the first, second and third central conductors 11, 12, 13 are bent along the plate-shaped magnet 15 to overlap one another at intersection angles of substantially 120° on the upper surface 15*a* of the plate-shaped magnet 15. In addition, although omitted in the figure, the respective central conductors 11 to 13 are individually insulated on the upper surface 15*a* of the plate-shaped magnet 15 by insulating sheets.

Also, provided on tip end portions of the respective central conductors 11 to 13, respectively, are ports P1, P2, P3 to project laterally of the plate-shaped magnet 15.

And the first central conductor 11 is connected to the capacitor plate 24 via the port P1, the second central conductor 12 is connected to the capacitor plate 25 via the port P2, and the third central conductor 13 is connected to the capacitor plate 26 and the terminating resistance 27 via the port P3, Also, the lower yoke 22 is mainly composed of a base 22*a*, on which the capacitor plates 25, 26, the terminating resistance plate 27, and the magnetic assembly 10 are placed, a pair of wall portions 22*b*, 22*b* provided upright on both ends of the base 22*a* to face each other, and input/output terminals (independent terminals) 31, 32 arranged to be spaced away from the base 22*a*.

The base 22*a* and the wall portions 22*b*, 22*b* are formed by bending a metallic sheet of soft iron or the like and silver-plating for prevention of noise is applied to at least front surface sides thereof.

Also, a plurality of earth terminals 22*d*, . . . are formed integrally on those ends 22*c*, 22*c* of the base 22*a*, which are not connected to the wall portions 22*b*, to project.

Also, side wall portions 22*e*, 22*e* of a resin indicated by alternate long and short dash lines are formed on the ends 22*c*, 22*c* of the lower yoke 22 to bridge between the pair of wall portions 22*b*, 22*b*. The input/output terminals 31, 32 are joined to and held by the side wall portions 22*e*, 22*e*. Accordingly, the input/output terminals 31, 32 are fixed to the lower yoke 22 through the side wall portions 22*e*, 22*e* in an insulated condition.

Notches 22*f*, 22*f* are provided between the base 22*a* and one of the wall portions 22*b*, and portions of the input/output terminals 31, 32 are arranged in the notches 22*f*. And terminal supports 22*g* made of the same resin as that of the side wall portions 22*e* are formed in the notches 22*f*, and the input/output terminals 31, 32 are bonded to the terminal supports 22*g* to be fixed to the lower yoke 22 in an insulated condition.

In addition, the input/output terminals 31, 32, the side wall portions 22*e*, 22*e*, and the lower yoke 22 will be described further in detail in connection with a method, described later, of manufacturing the lower yoke.

Also, the common electrode 14 of the magnetic assembly 10, the capacitor plates 25, 26, and the terminating resistance plate 27 are connected electrically to the earth terminals 22*d*, . . . via the base 22*a* of the lower yoke 22.

Also, the first and second central conductors 11, 12, respectively, are connected to the capacitor plates 24, 25 via the ports P1, P2 and to the input/output terminals 31, 32. More specifically, the port PI is connected at its base end to the capacitor plate 24 and at its tip end to the input/output terminal 31, and the port P2 is connected at its base end to the capacitor plate 25 and at its tip end to the input/output terminal 32.

Since the input/output terminals 31, 32 and the lower yoke 22 are insulated from each other, insulation is maintained between the input/output terminals 31, 32 and the earth terminals 22*d*, . . . , whereby the non-reciprocal circuit element 1 shown in FIG. 1 can be made an isolator.

Subsequently, a method of manufacturing a housing for electronic parts, according to the invention, will be described below with the lower yoke 22 of the non-reciprocal circuit element as an example.

The method of manufacturing the lower yoke 22 comprises the steps of forming a provisional connection and side wall portions, which are made of a resin, on a metallic housing part support, cutting off and removing connections of the housing part support, applying plating to the housing part support, and removing the provisional connection to take out a housing part.

Figure 2:
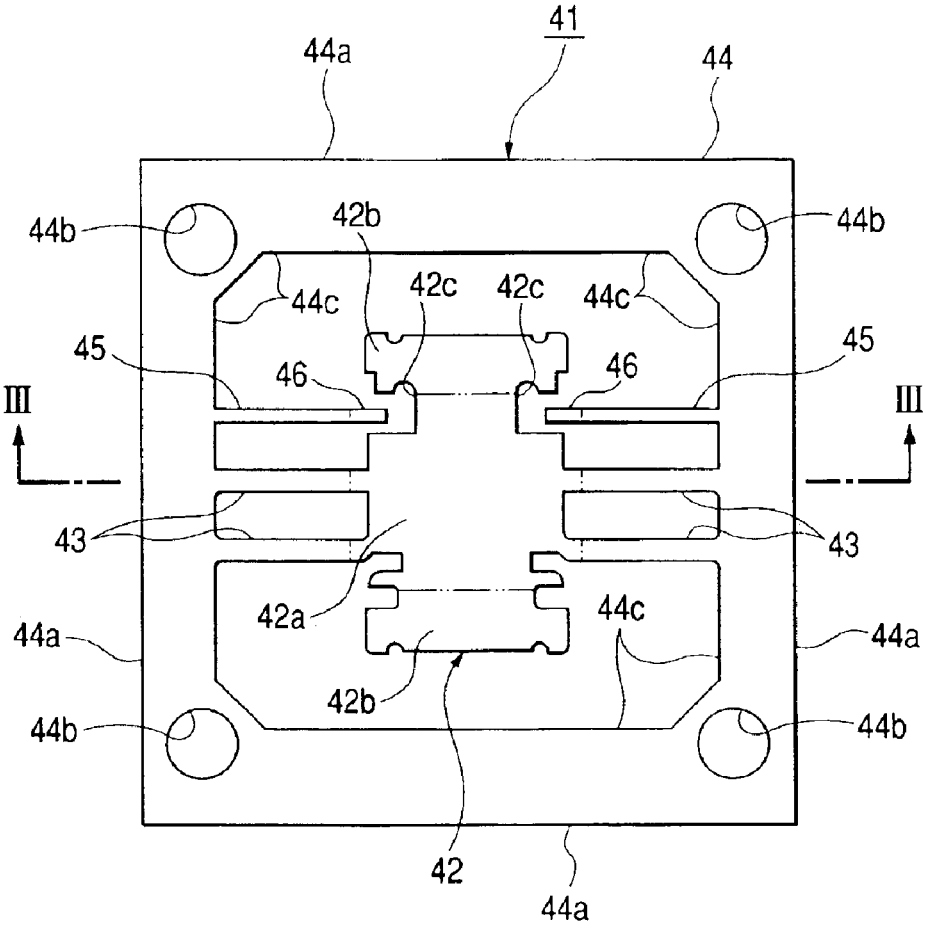
FIG. 2 is a process drawing illustrating a method of manufacturing a lower yoke of the isolator according to the embodiment of the invention.
Figure 3:
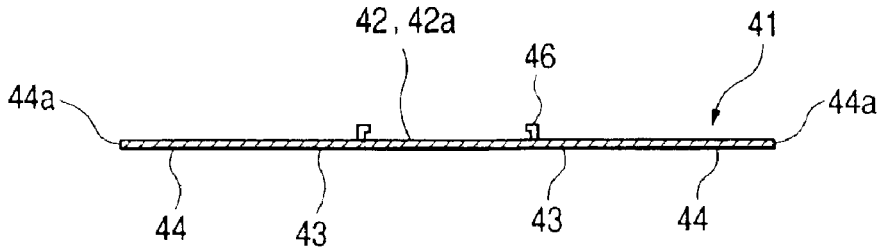
FIG. 3 is a cross sectional view taken along the line III III in FIG. 2.

First, a metallic plate-shaped housing part support 41 as shown in FIGS. 2 and 3 is prepared. The housing part support 41 is a so-called hoop member, and a housing part 42 is connected to a frame 44 through connections 43, . . . .

The housing part 42 is finally cut off from the housing part support 41 to constitute the lower yoke 22 of the non-reciprocal circuit element 1, and comprises a plate-shaped housing base 42*a*, and plate-shaped wall forming portions 42*b*, 42*b* connected to both ends of the housing base 42*a* in a vertical direction in FIG. 2.

The frame 44 is formed to be spaced away from the housing part 42 in a manner to surround the same. Outer edges 44*a* of the frame 44 are shaped to assume a substantially square as viewed in plan view, and positioning holes 44*b* are provided in positions corresponding to corners of the square.

Also, the plate-shaped connections 43, . . . connecting the housing part 42 to the frame 44 are formed on inner edges 44*c* of the frame 44 to project therefrom. The connections 43, . . . are four in number as shown in FIG. 2, and provided two to both right and left sides of the housing part 42 in the figure.

Also, formed on the inner edges 44*c* of the frame 44 are a pair of supports 45, 45 to project toward both right and left sides of the housing part 42 in the figure, and provided on tip ends of the respective supports 45, 45 are independent terminals 46, 46. The independent terminals 46, 46 are formed to be spaced away from the housing part 42.

A pair of notches 42*c*, 42*c* are provided between the housing base 42*a* of the housing part 42 and one of the wall forming portions 42*b*, and tip ends of the independent terminals 46, 46 are disposed in the notches 42*c*, 42*c*.

Figure 4:
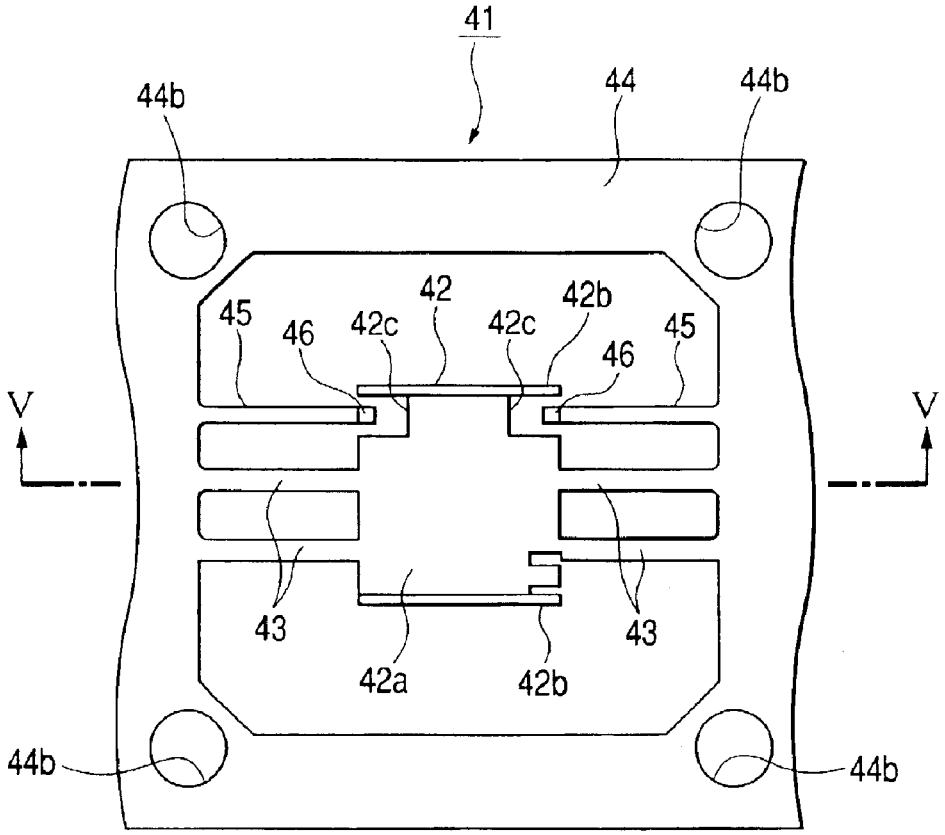
FIG. 4 is a process drawing illustrating the method of manufacturing the lower yoke of the isolator, according to the embodiment of the invention.
Figure 5:
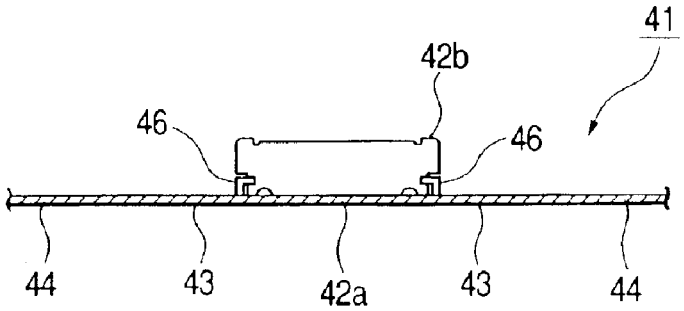
FIG. 5 is a cross sectional view taken along the line V—V in FIG. 4.

Subsequently, connections between the housing base 42*a* and the wall forming portions 42*b*, 42*b* are bent by means of press working or the like, so that the wall forming portions 42*b*, 42*b* are made upright from both ends of the housing base 42*a*, as shown in FIGS. 4 and 5.

Figure 6:
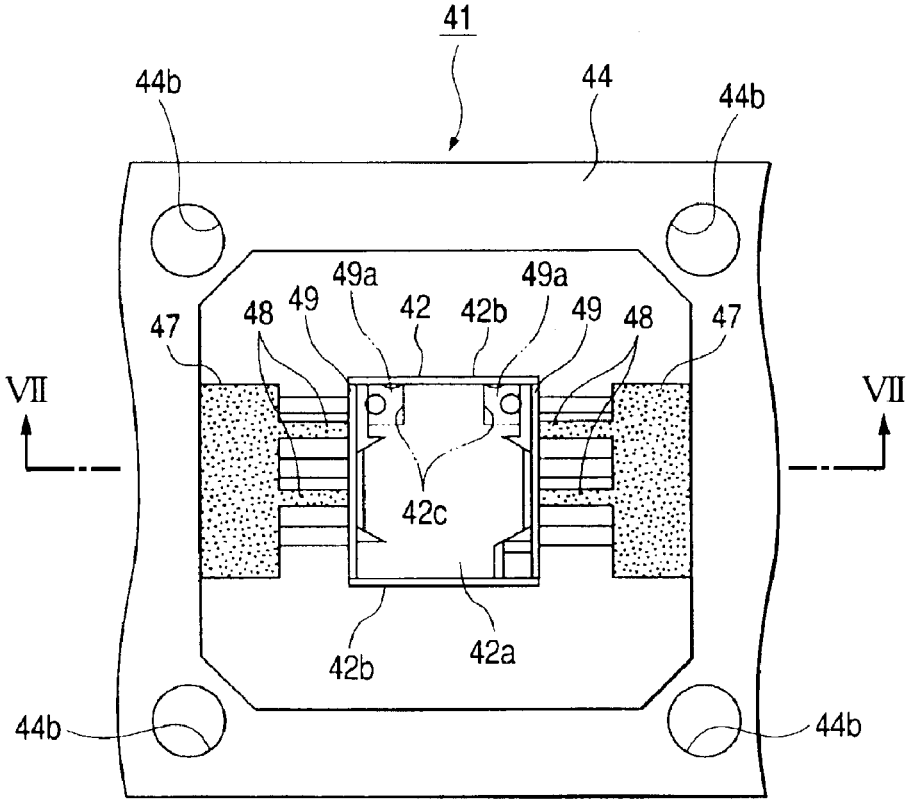
FIG. 6 is a process drawing illustrating a method of manufacturing a lower yoke of an isolator, according to an embodiment of the invention.
Figure 7:
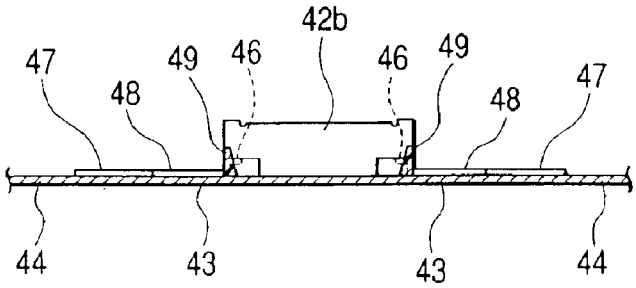
FIG. 7 is a cross sectional view taken along the line VII—VII in FIG. 6.

Subsequently, provisional connection bases 47, provisional connections 48, which are made of a resin, and side wall portions 49 are formed on a housing part support 41 by means of insert molding as shown in FIGS. 6 and 7.

The provisional connection bases 47 are formed on sides of connections 43, 43 and supports 45 toward a frame 44 to bridge over the respective connections 43, 43 and the supports 45.

Also, the provisional connections 48 are formed to project toward the housing part 42 from the provisional connection bases 47 to be disposed between the supports 45 and the connections 43 and between the connections 43, 43.

Further, the side wall portions 49 are formed in the vicinity of connection between a housing base 42*a* and the connections 43, 43 to be connected to a pair of wall forming portions 42*b*, 42*b*, respectively. Also, parts of the side wall portions 49 are filled in notches 42*c* of the housing part 42 to form terminal supports 49*a*, and independent terminals 46 are joined to and held by the terminal supports 49*a*. In this manner, the independent terminals 46 are joined to the housing part 42 through the side wall portions 49 in an insulated condition.

The provisional connection bases 47, the provisional connections 48, the side wall portions 49, and the terminal supports 49*a* are formed integrally from the same resin. Preferably, engineering plastics such as liquid crystal polymer, or the like is used as the resin.

Formation of the provisional connections 48 and the side wall portions 49 has the frame 44 and the housing part 42 connected to each other through the provisional connections 48.

Figure 8:
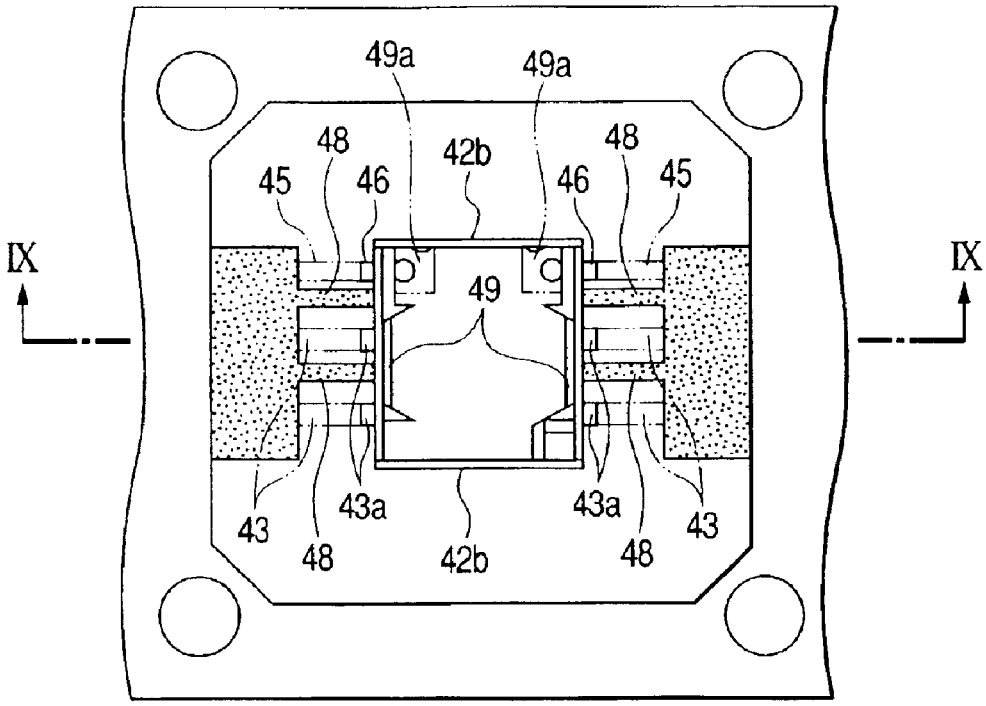
FIG. 8 is a process drawing illustrating the method of manufacturing the lower yoke of the isolator, according to the embodiment of the invention.
Figure 9:
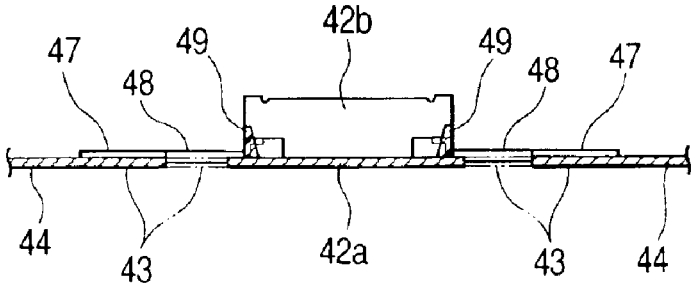
FIG. 9 is a cross sectional view taken along the line IX—IX in FIG. 8.

Subsequently, the connections 43 are cut off and removed as shown in FIGS. 8 and 9 (shown by broken lines in the figures). The connections 43 are preferably cut off in a manner to leave portions thereof toward the housing part 42. The portions 43*a* of the connections 43 thus left finally make earth terminals 22*d* of the lower yoke 22.

Also, simultaneously with cutting-off and removal of the connections 43, the supports 45 are also cut off and removed (shown by broken lines in the figures). Removal of the supports 45 results in the independent terminals 46 being separated from the frame 44 to be supported only by the housing part 42 through the side wall portions 49.

Removal of the supports 42 and the connections 43 results in the frame 44 and the housing part 42 being connected to each other only by the provisional connections 48.

Subsequently, electrolytic plating is applied to the housing part support 41 in a state, in which the connections 43 and the supports 42 are cut off and removed. Electrolytic plating is applied to subject surfaces of the housing part 42 to plating processing. At this time, cut surfaces of the portions 43*a* of the connections 43 are also subjected to plating at the same time. Plating applied is preferably silver plating or the like. Application of silver plating with high conductivity makes it possible to reduce noise.

Figure 10:
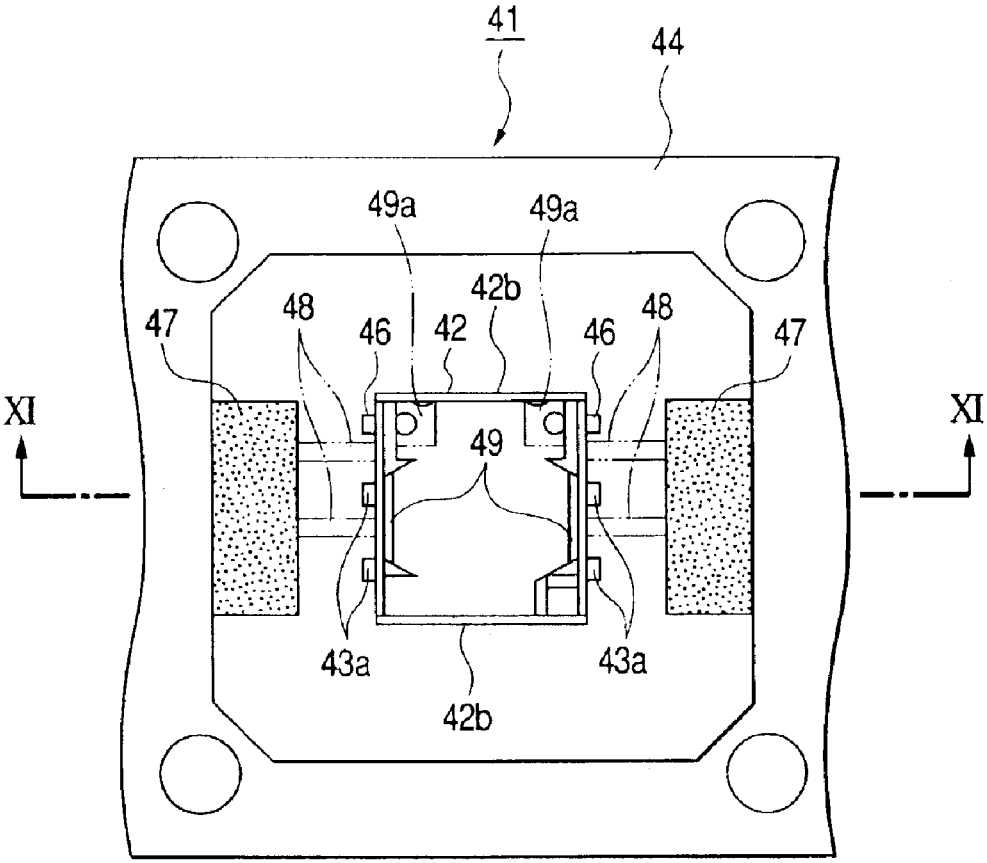
FIG. 10 is a process drawing illustrating the method of manufacturing the lower yoke of the isolator, according to the embodiment of the invention.
Figure 11:
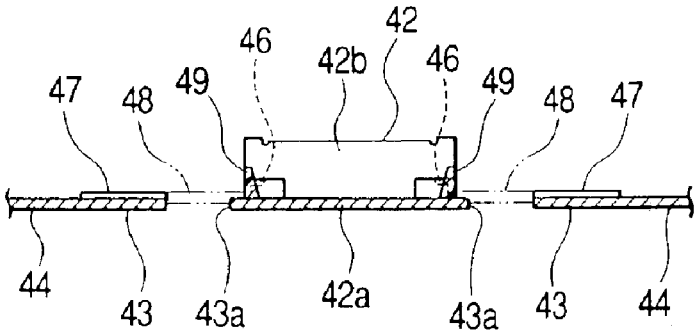
FIG. 11 is a cross sectional view taken along the line XI—XI in FIG. 10.

Finally, the provisional connections 48 are cut off as shown in FIGS. 10 and 11. The provisional connections 48 are cut off from the side wall portions 49 in a state, in which the side wall portions 49 are left on the housing part 42.

Cutting-off of the provisional connections 48 makes it possible to separate the housing part 42 from the frame 44, so that a lower yoke 22 constituted by the housing part 42 can be obtained.

More specifically, the housing base 42*a* of the housing part 42 makes a base 22*a* of the lower yoke 22, the wall forming portions 42*b* of the housing part 42 make wall portions 22*b* of the lower yoke 22, and the side wall portions 49 of the housing part 42 make side wall portions 22*e* of the lower yoke 22. Also, the independent terminals 46, 46 make input/output terminals 31, 32 mounted to the lower yoke 22 in an insulated condition.

Also, the notches 42*c* make notches 22*f* of the lower yoke 22, and the terminal supports 49*a* make terminal supports 22*g* of the lower yoke 22.

Since the method of manufacturing the lower yoke 22 comprises cutting off and removing the connections 43 after formation of the provisional connections 48 and applying plating to surfaces of the housing part 42 including the portions 43*a* of the connections 43, it is possible to apply plating to a greater part of the housing part 42 including cut portions of the connections 43, so that those portions, on which plating is not applied, are decreased as compared with the prior art to improve the high frequency property and enhance soldering in strength, which makes it possible to decrease contact failure.

Also, since the supports 45 together with the connections 43 are cut off and removed in a state, in which the independent terminals 46 are joined to the side wall portions 49, the independent terminals 46 can be joined to the housing part 42 in an insulated condition and used as the input/output terminals 31, 32 of the non-reciprocal circuit element 1.

In addition, since the independent terminals 46 are joined to the housing part 42 in an insulated condition, electrification is not effected at the time of electrolytic plating, which results in plating being not applied to cut surfaces of the independent terminals 46 and the supports 45. In order to improve this, it is preferable to provide, for example, auxiliary connections between the housing base 42*a* and the independent terminals 46 to enable electrification to the independent terminals 46 for plating and to cut off the auxiliary connections after the application of plating.

As described above in detail, since the method of manufacturing a housing for electronic parts, according to the invention, comprises after formation of the provisional connections, cutting off and removing the connections, and applying plating to surfaces of the housing part including cut portions of the connections, a greater part of the housing part can be subjected to plating, and those portions, on which plating is not applied, are decreased as compared with the prior art to improve the high frequency property and enhance soldering in strength, which makes it possible to decrease contact failure.

What is claimed is:

1. A method of manufacturing a housing for an electronic part, the method comprising:

forming a metallic housing part having provision for at least one resin side wall portion, and a frame which surrounds the metallic housing part, the frame having connections which join the metallic housing part and the frame;

forming the at least one resin side wall portion connected to the metallic housing part, the resin side wall portion having provisional connections which join the resin side wall portion and the frame;

cutting and removing the connections;

plating exposed surfaces of the metallic housing part; and, removing the provisional connections.

2. The method according to claim 1, further comprising providing supports, which project toward the housing part from the frame, and providing independent terminals on tip ends of the supports; and joining the independent terminals to the side wall portions at the time of formation of the provisional connections and the side wall portions, and then cutting off and removing the supports together with the connections.

3. The method according to claim 1, wherein cut portions of the connections on a side of the housing part make separate terminals.

4. The method according to claim 1, further comprising bending the housing part to form a housing base and wall portions prior to forming the resin side wall portions, the housing base defining a bottom surface of the housing, the wall portions defining side walls of the housing.

* * * * *